United States Patent [19]

Lake

[11] 4,327,935

[45] May 4, 1982

[54] APPARATUS FOR ATTACHING TO A SNOW SKI

[76] Inventor: Lawrence K. Lake, 342 Avila Rd., San Mateo, Calif. 94402

[21] Appl. No.: 31,624

[22] Filed: Apr. 19, 1979

[51] Int. Cl.[3] ..... A63C 7/00

[52] U.S. Cl. ..... 280/604

[58] Field of Search ..... 280/604, 605, 601, 11.37 E, 280/11.37 G, 606, 809

[56] References Cited

U.S. PATENT DOCUMENTS 2,316,252 4/1943 Karlsson ..... 280/605

FOREIGN PATENT DOCUMENTS 1041566 10/1978 Canada ..... 280/604
361421 10/1922 Fed. Rep. of Germany ..... 280/604
459218 9/1950 Italy ..... 280/604
98415 3/1940 Sweden ..... 280/604

*Primary Examiner*—Randolph A. Reese
*Assistant Examiner*—Milton L. Smith
*Attorney, Agent, or Firm*—David A. Boone

[57] ABSTRACT

Apparatus for attaching to a snow ski includes a retractable member for extending beyond the edge of the ski to provide a semi-circular engaging surface that a ski pole can be butted up against. The apparatus allows a skier to easily maintain his position on a slope or secure the position of one ski while moving the other forward to a new position. The apparatus is also balanced along the longitudinal axis of the ski so that when the member is retracted the skis are balanced along the longitudinal axis.

4 Claims, 14 Drawing Figures

APPARATUS FOR ATTACHING TO A SNOW SKI

BACKGROUND AND SUMMARY OF THE INVENTION

Skiers have sought to minimize the friction between the snow and the bottom of the ski to maximize downhill performance. The smooth surface of the bottom of the ski creates problems when a skier is not downhill skiing, e.g. when a skier is attempting to maintain his position on a slope or when he is attempting to move up a slope. Cross-country skiers in particular are beset with these problems.

Previously, a skier could try to side-step up the hill or slope by placing his skis so that their longitudinal axis was essentially perpendicular to the prevailing slope of the hill. This was very tiring for the skier because of the strenuous physical exertion involved. Ascending a long or steep slope required frequent rest periods.

Another prior technique utilized special waxes to increase the friction between the ski and the snow. Unfortunately, the wax used seriously degraded downhill performance and had to be removed when descending a slope.

Another technique used was the placement of saw-toothed or triangular-shaped wedges on the bottom of the skis. This technique created the desired traction when the back pressure was applied to the ski but adversely affected downhill performance because of the irregular surface contacting the snow. In accordance with the preferred embodiment of the present invention, a ski anchor comprises a fixed member for attaching to a ski. Attached to the fixed member is a retractable member for extending beyond the edge of the ski. This retractable member includes a semi-circular shaped surface for engaging a ski pole. The preferred embodiment is mounted on the snow ski in a position just forward of the bindings. The unit is constructed so that when the retractable member is in the closed position it is balanced around the longitudinal axis of the snow ski. An indentation is provided in the retractable member so that the ski pole can be inserted therein and used to place the retractable member in the closed or open position without requiring the skier to bend over. In the preferred embodiment, the retractable member will yield to pressure on its forward surface and move towards the closed position without locking closed. This allows the skier to position the pole and then move the ski forward allowing the retractable member to hit the ski pole in position. The retractable member will move towards the closed position as the ski is moved past the pole. Once the ski is past the pole the retractable member will snap back into position. The skier may then allow the ski to move backwards until it firmly engages with the ski pole.

A BRIEF DESCRIPTION OF THE DRAWINGS

DESCRIPTION OF THE PREFERRED EMBODIMENT

Figure 1:
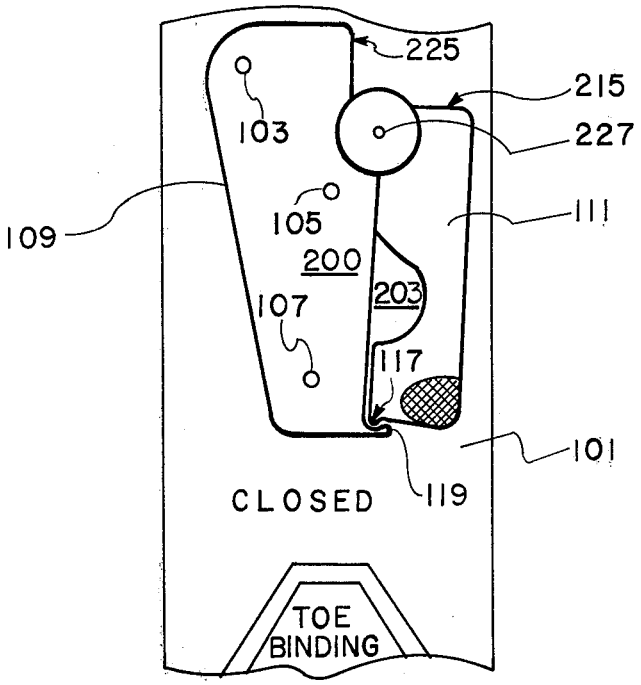
FIG. 1 is a top view of the preferred embodiment in position on a ski and in the closed position.

Referring now to FIG. 1 there is shown the preferred embodiment 200 attached to a snow ski 101 of which only a portion is shown. Note that the preferred embodiment is mounted in front of the ski bindings 206 of which only a portion is shown. The main body 109 of the preferred embodiment is attached to the ski by fasteners 103, 105, and 107. Extendable member 111 is held in the closed position by the interlocking of portion 117 of the extendable member and lip 119 of the body 109. The retractable member is forced to the open position by placing the ski pole in opening 203 and forcing the lobe 117 of extendable member 111 to pass over portion 119 of the body 109. Once retractable member 111 is disengaged from the closed position it will extend beyond the right-most ski surface by pivoting around pivot joint 227 until surface 215 of extendable member 111 is up against surface 225 of the body 109. In the preferred embodiment, spring loading about pivot 227 is used to cause extendable member 111 to assume the fully extended position whenever lip 117 and lip 119 are not engaged in the locked position.

Figure 2:
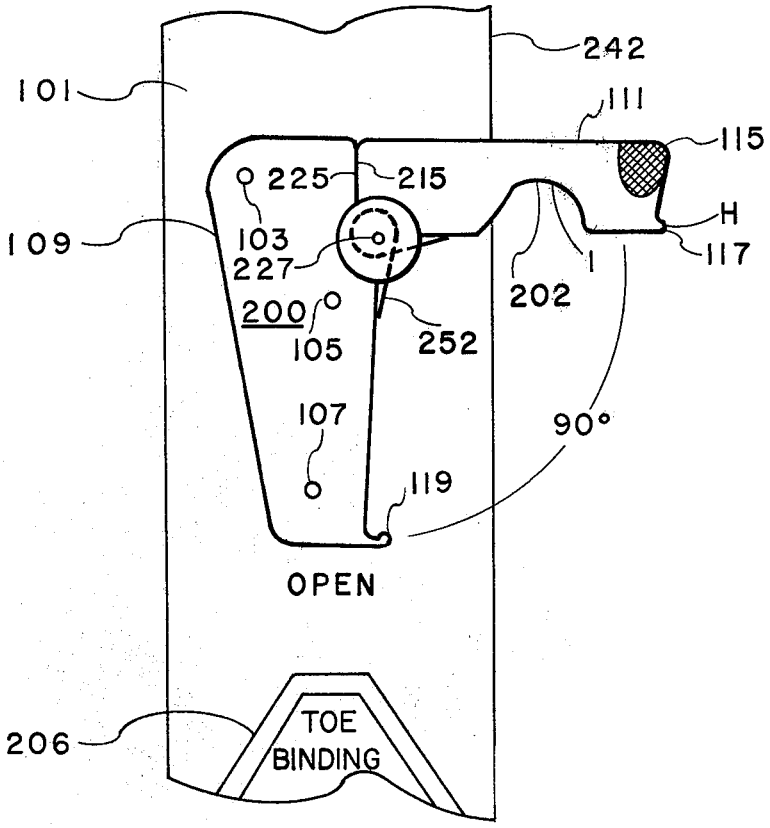
FIG. 2 is a top view of the preferred embodiment in position on a ski and in the open position.

Referring now to FIG. 2 the preferred embodiment is shown with extendable member 111 fully extended to beyond the right-most edge 242 of ski 101. As noted above, a spring 252 is used in the preferred embodiment to cause the extendable member to pivot about pivot 227 to the fully open position when it is not locked in the closed position. In FIG. 2 the extendable member has pivoted the maximum allowable amount and surface 215 is butted up against the stop provided by surface 225. The longitudinal axis of extendable member 111 in the fully extended position is at approximately a 90° angular rotation with respect to the longitudinal axis of ski 101.

Spring 252 which maintains tension of the extendable member 111 in the open position may be easily overcome by placing the ski pole in the indentation 115 in extendable arm 111 and moving extendable member 111 to the closed position. Locking in the closed position is accomplished by guiding the extendable member so that lip 117 is guided to pass and engage lip 119. In the preferred embodiment lips 117 and 119 are approximately 1/16 inch in radius and are positioned so simply that the interference fit created is more than sufficient to resist the opening bias tension of spring 252 and the inertial forces encountered during skiing.

Surface 202 is approximately ½ inch in diameter which is the typical diameter of most ski poles currently in use. The base and extendable member portions of the preferred embodiment may be construed from metal castings or from multi-layers of plastic material.

Figure 3:
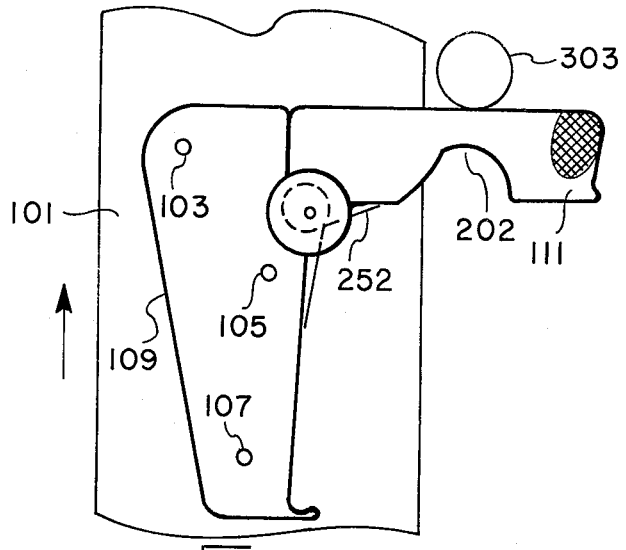
FIG. 3 is an illustration of the preferred embodiment in the open position while the ski is being moved to engage the ski pole.
Figure 4:
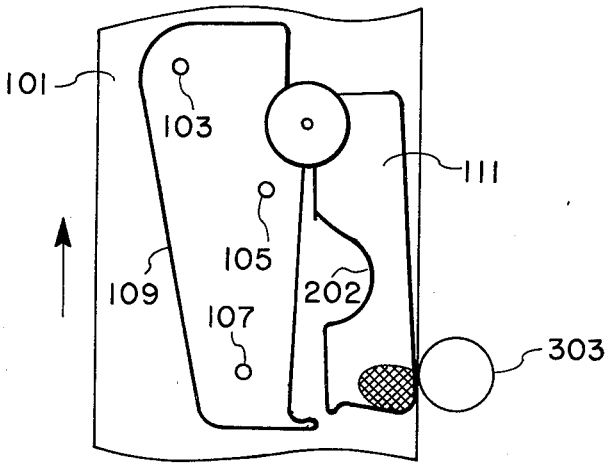
FIG. 4 is an illustration of the preferred embodiment on a ski which is engaging a ski pole which is causing the retractable portion to move towards the closed position.
Figure 5:
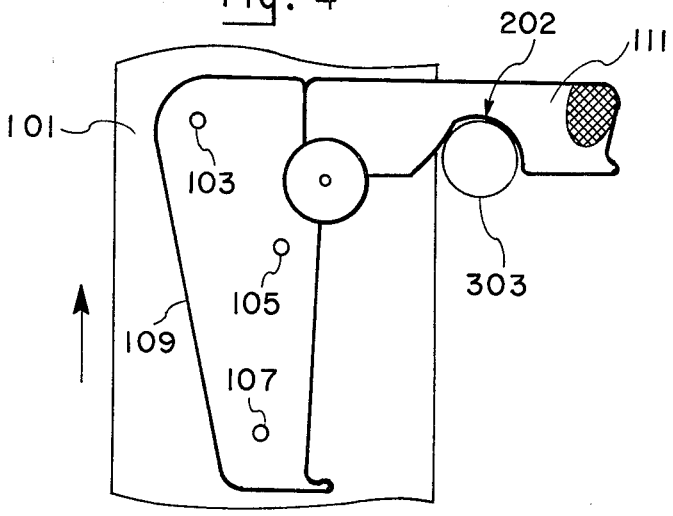
FIG. 5 is an illustration of the preferred embodiment in the open position and engaging a ski pole.

Referring now to FIGS. 3, 4 and 5, there is shown a sequence of events as a skier moves a ski, having the preferred embodiment attached, forward toward a ski pole. In this example, the ski being moved forward is the right ski, 101. Right ski pole 303 engages the extendable member 111 as the ski is moved forward. Since the biased tension provided by spring 252 is designed to be little more than enough to hold extendable member 111 in the extended position when it is not locked in place, extendable member 111 is folded inward toward the locked position as shown in FIG. 4 as the ski pole 303 engages extended pole member 111 and the ski continues to move forward. As shown in FIG. 5, when the ski pole has passed the extendable member 111, extendable member 111 will again return to the fully extended position because of the bias tension provided by spring 252. The skier then allows ski 101 to move backwards and allow ski pole 303 to engage extendable member 111 at opening 202. The skier then may maintain his position depending only on how firmly the ski pole 303 is embedded in the snow surface.

Figure 6A:
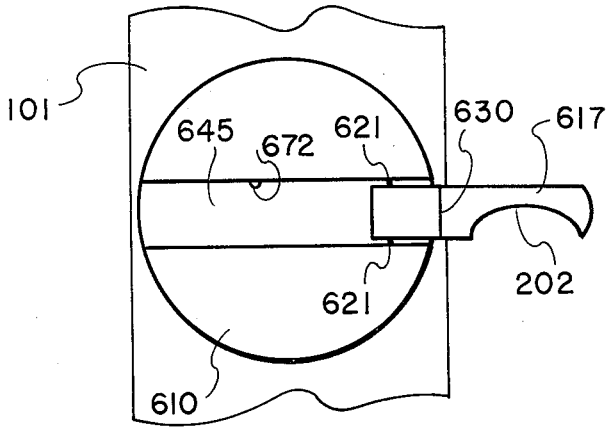
FIGS. 6A and 6B are top views of an alternate embodiment of the present invention in the open and closed positions, respectively.
Figure 6B:
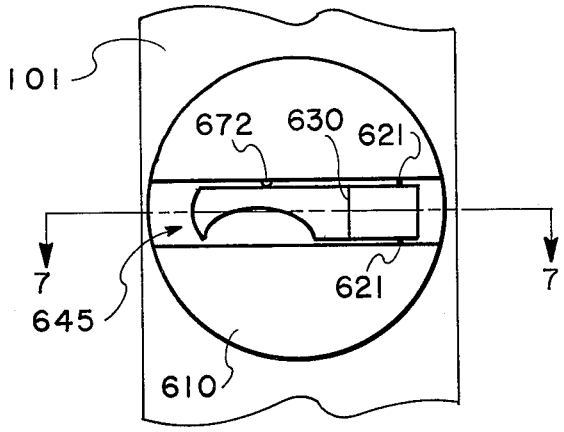
Figure 7A:
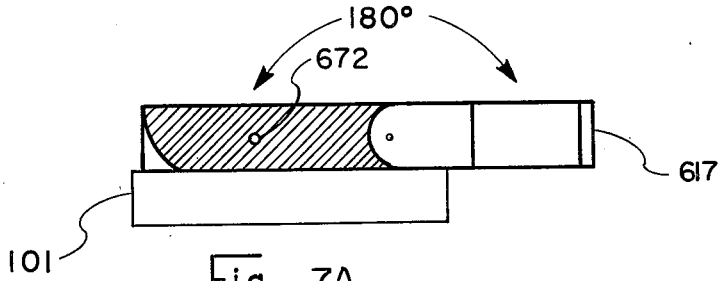
FIGS. 7A and 7B are side sectional views of the alternate embodiment shown in FIG. 6 in the open and the closed positions, respectively.
Figure 7B:
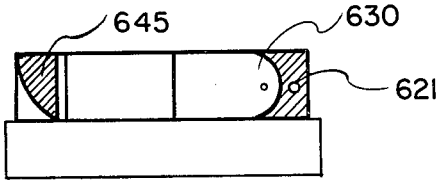
Figure 8:
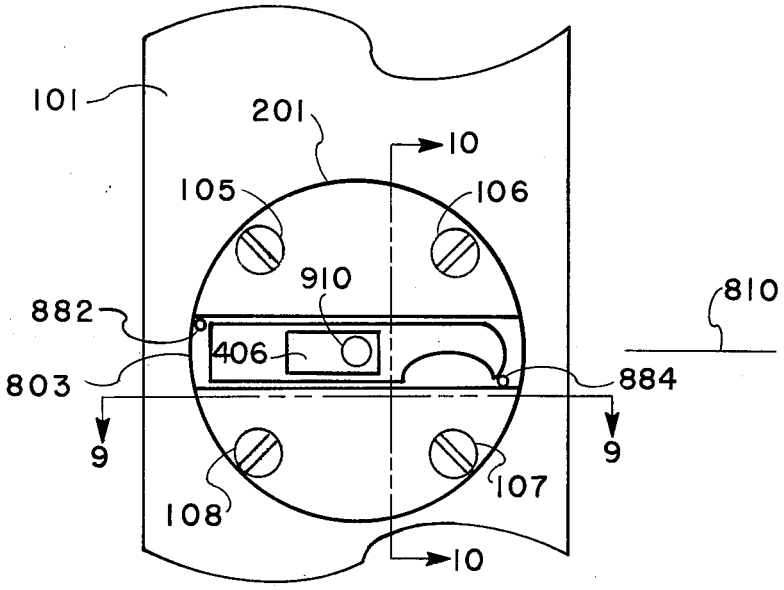
FIG. 8 is a top illustration of a second alternate embodiment of the present invention.

Referring now to FIGS. 6A and 6B there is shown an alternate embodiment of the present invention. In this embodiment, a pivot arm 617 is attached via a pin 621 to a circular member 610. The pivot arm 617 has a thickness which is approximately equal to the depth of a channel 645 defined by blocks. Pivot arm 617 may be rigid or it may be provided with a folding type mechanism at point 630 such as that described above with respect to FIGS. 1 through 5. In this embodiment, when it is not desired to use the pivot arm to engage the ski pole, it may be flipped upwards and to the left to lie flat in channel 645. A protrusion 672, e.g. a spring loaded ball bearing is provided to cause an interference fit to hold pivot arm 617 in channel 645 when not in use. A similar protrusion 674 is provided to cause an interference fit to hold pivot arm 617 securely in channel 645 when in the open position. Note also that this embodiment is also designed to be balanced about the longitudinal axis of the ski. FIGS. 7A and 7B are sectional views showing the pivot arm in the open and closed positions, respectively.

Referring now to FIGS. 8, 9, 10 and 11, there is shown an embodiment of the present invention. In this embodiment, body 201 is coupled to ski 101 by fasteners 105, 106, 107 and 108. Extendable member 407 is moved in and out of a channel 803 provided in the top of body 201 in the direction shown by arrow 810. This is accomplished by placing the end of a ski pole in groove 406 and applying the necessary force in the direction movement is desired.

Figure 9:
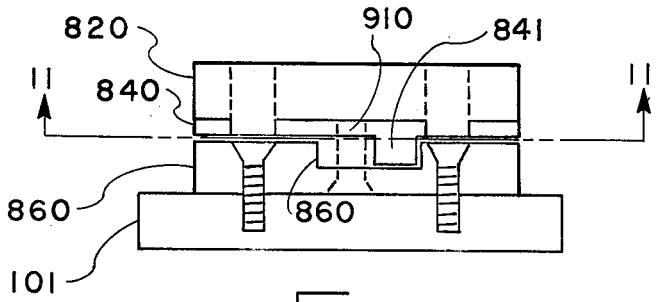
FIG. 9 is a sectional view of the embodiment of FIG. 8.
Figure 10:
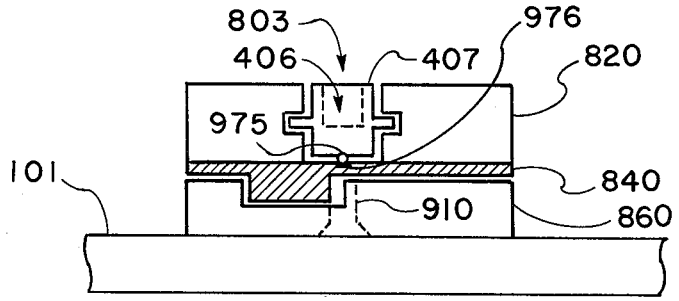
FIG. 10 is a sectional view of the embodiment of FIG. 8.
Figure 11:
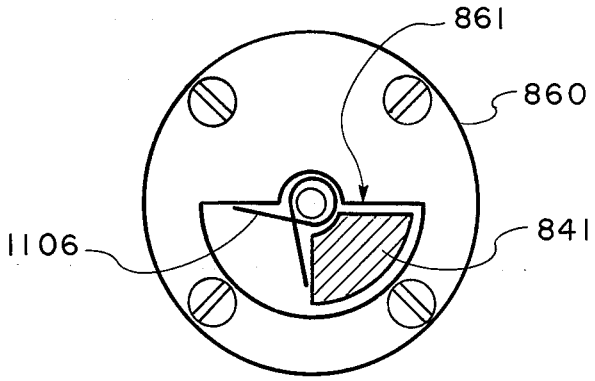
FIG. 11 is an illustration of the stop mechanism used in the embodiment of FIG. 8.

As shown in FIG. 9, body 201 comprises top plate 820 which is secured to a middle plate 840, and a bottom plate 860 which is secured to ski 101. The assembly comprising plates 820 and 840 is secured to plate 860 by a post and bushing assembly 910 which allows rotational freedom between members 860 and 840, thus forming a turntable. However, this rotational freedom is limited to 90° because of the interaction of portion 861 of plate 860 and portion 841 of plate 840 which is more closely shown in FIG. 11.

Extendable member 407 travels in and out of channel 803 and is locked in either the fully extended or the fully retracted position by the interaction of a ball bearing 975 biased by a spring clip 976 which is positioned in a recessed portion in channel 803. Ball bearing 975 rides in a groove in channel 803 and two detents in the groove provide a locking action in the extended and retracted positions.

Figure 12:
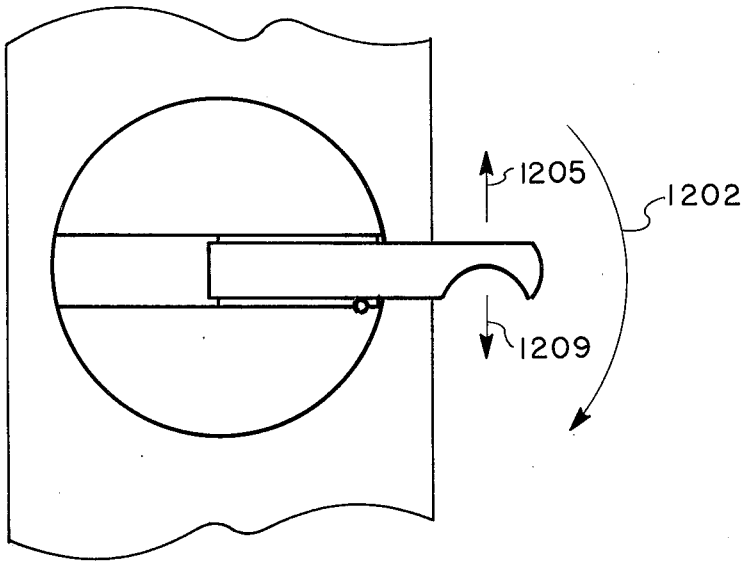
FIG. 12 is a top view of the embodiment of FIG. 8 showing the extendable portion fully extended.

In this embodiment shown in FIGS. 9–12, the entire turntable top portion, i.e. plates 820 and 840 as well as extendable member 407, rotates as shown by arrow 1202 in FIG. 12. This turntable assembly is returned by a leaf spring 1106 to the position shown in FIG. 12 when the force in the direction of arrow 1209 is removed. Note that movement in the opposite direction as indicated by arrow 1205 is prevented by the abutment of portion 841 of 840 up against portion 861 of portion 860. Extendable member 407 is retained in the channel 803 by stops 882 and 884 which prevent extendable member 407 from being removed. It should also be noted that the turntable mechanism described with respect to FIGS. 8–12 could be employed with the extendable member design described with respect to FIGS. 5 and 6.

I claim:

1. Apparatus for attaching to a snow ski, said apparatus comprising:

a base means for attaching to said ski;

extendable means coupled to said base means for retractably extending beyond an edge of said ski;

said extendable means comprising engaging means for providing a surface to engage a ski pole and having a freedom of movement between first and second relative positions, said first relative position being the intended position for said extendable means to engage said ski pole, and said second relative position being the retracted position;

locking means coupled to said extendable means and said base means for retaining said extendable means in said second relative position and release means coupled to said locking means for releasing said extendable means from being contained in said second relative position in response to an operator manifestation indicating it is desired to release said extendable means and allow it to extend beyond the edge of said ski; and rotating means for causing said extendable means to yield to pressure from an object from a first preselected direction and to allow said extendable means to move out of the path of said object as the object contacts and passes by said extendable means.

2. Apparatus as in claim 1 wherein said locking means further comprises means for retaining said extendable means in said first relative position.

3. Apparatus as in claim 1 and further comprising means for providing an engagement point on said extendable member to facilitate operator movement thereof between said first and second relative positions.

4. Apparatus as in claim 1 and further including biasing means coupled to said extendable means and said base means for tending to hold said extendable means extended beyond the edge of said ski.

* * * * *